United States Patent [19]

Neitz

[11] 4,319,759

[45] Mar. 16, 1982

[54] TOE STOP AND ROLLER SKATE COMBINATION

[76] Inventor: Paul D. Neitz, 1400 Massillon Rd., Akron, Ohio 44306

[21] Appl. No.: 144,894

[22] Filed: Apr. 29, 1980

[51] Int. Cl.[3] ..... A63C 17/14

[52] U.S. Cl. ..... 280/11.2

[58] Field of Search ..... 280/11.2

[56] References Cited

U.S. PATENT DOCUMENTS

| | | | |
|---|---|---|---|
| 2,595,751 | 5/1952 | Balstad | 280/11.2 X |
| 3,016,246 | 1/1962 | Ware | 280/11.2 |
| 3,250,544 | 5/1966 | Ware | 280/11.2 |

*Primary Examiner*—Joseph F. Peters, Jr.
*Assistant Examiner*—Donald W. Underwood
*Attorney, Agent, or Firm*—Oldham, Oldham, Hudak & Weber Co.

[57] ABSTRACT

A roller skate and toe stop combination made from a metal skate plate having a front section with a downwardly inclined lower surface and a toe stop mounted on such front section and protruding downwardly from such section, wherein securing means extend between said toe stop and front section for operatively mounting the toe stop on the skate plate; and a metal lock pin is embedded within the stop member and extends therefrom towards the skate plate, which skate plate section has a recess therein for operatively engaging the protruding portion of the lock pin to aid in mounting the toe stop on the skate plate and preventing rotation of the stop on its mounting means, as well as to secure the stop in position more firmly.

2 Claims, 4 Drawing Figures

TOE STOP AND ROLLER SKATE COMBINATION

BACKGROUND OF INVENTION

Heretofore there have been a number of efforts made to provide various types of toe stops on roller skates. These toe stops are present on the roller skates to aid the skater in stopping and maintaining control of the skating action. A relatively large number of various types of patented toe stops have been provided heretofore, as represented by the structures shown in U.S. Pat. Nos. 3,180,651; 3,112,120 and 3,773,339.

A number of these toe stops have functioned fairly effectively for the intended purposes, but the toe stops may be worn away quickly, or to be pulled off of its mounting means because of the relatively high stresses set up on the toe stops when in use. These stops, which normally are made from some type of a tough, durable plastic material, such as artificial or natural rubbers or synthetic plastic materials, do have a useful life in combination with a roller skate for providing braking action for the skater but a more durable unit would be very desirable.

If the plastic stop member does get disengaged from the skate, then the mounting structure for the toe stop is exposed, and it may damage the skating surface and/or it may make it difficult for the skater to maintain effective control of his skating speed and motions.

Accordingly, it is the general object of the present invention to provide a novel and improved, durable toe stop structure for a roller skate, and wherein the toe stop is operatively positioned on the skate and held against rotation by a secondary securing member operatively extending between the toe stop and the skate plate.

Another object of the invention is to use a conventional mounting system for positioning a toe stop onto a skate plate, and to add thereto a lock or anchor pin that is embedded at one end in the toe stop and protrudes therefrom towards the skate plate, which has a recess or aperture therein for receiving the protruding pin to operatively position the toe stop in engagement with the skate plate and aid in transmitting braking torque forces applied to the toe stop to the skate plate.

Another object of the invention is to provide an improved toe stop which has a good service life and which can be mounted upon existing roller skates with a minimum of change thereto, and which toe stop may have a variety of arcuately adjustable positions around its mounting means to aid in distributing wear around the toe stop when in use.

The foregoing and other objects and advantages of the invention will be made more apparent as the specification proceeds.

When referring to corresponding members shown in the drawings, and referred to in the specification, corresponding numerals are used to facilitate comparison therebetween.

Reference now is particularly made to the accompanying drawings, wherein.

SUBJECT MATTER OF THE INVENTION

Figure 1:
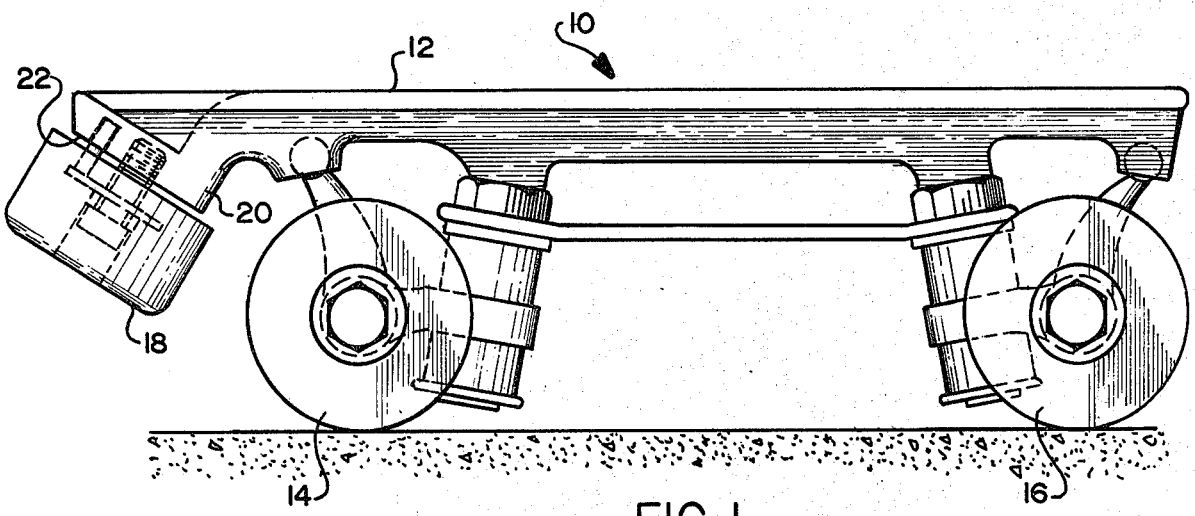
FIG. 1 is a side elevation of a conventional roller skate having a toe stop of the invention operatively secured thereto.
Figure 2:
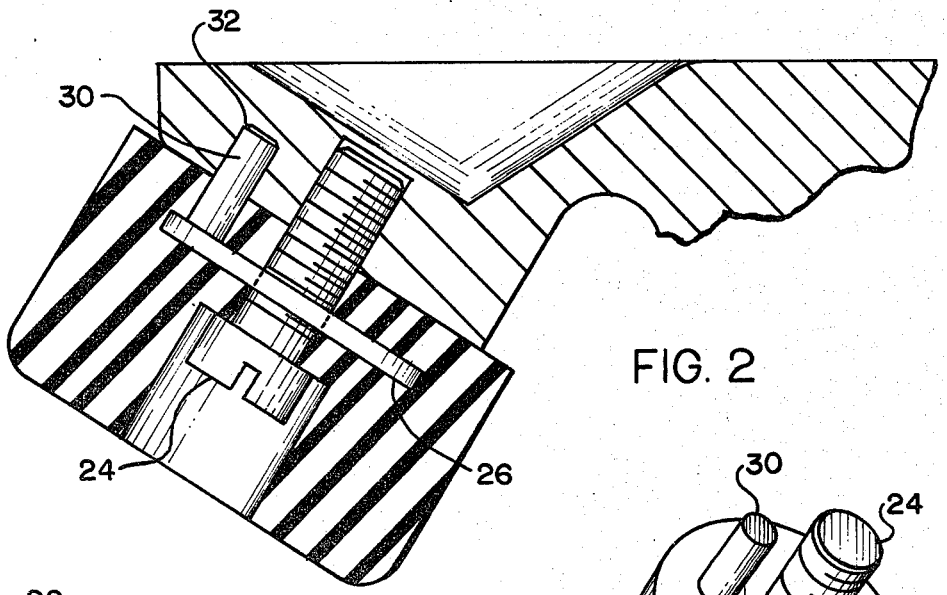
FIG. 2 is a fragmentary enlarged vertical section through the toe portion of the roller skate and frame of FIG. 1.
Figure 3:
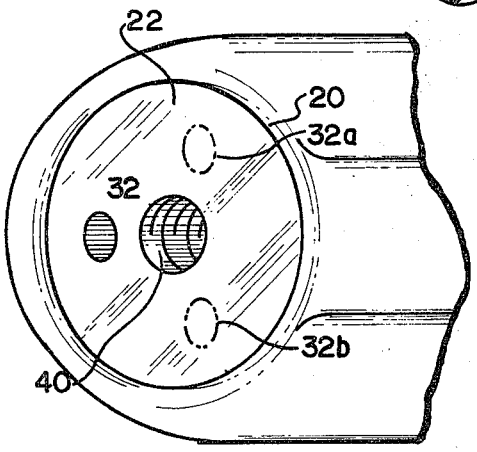
FIG. 3 is a bottom perspective view of the toe stop mounting plate of FIG. 2.
Figure 4:
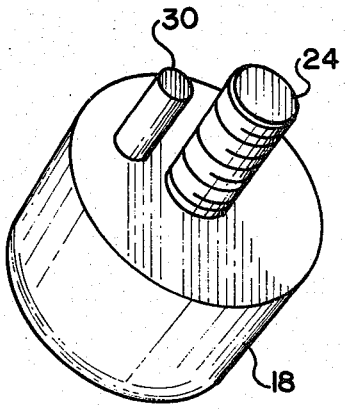
FIG. 4 is a bottom perspective view of the toe stop.

This invention relates to a roller skate including a metal skate or frame plate including a front section normally having a rearwardly directed downwardly inclined lower surface, a toe stop operatively positioned on the front section and extending downwardly therefrom, a conventional attaching member extending from the toe stop to the metal skate plate front section to position the toe stop thereon, and a lock pin embedded in a portion of the toe stop and protruding therefrom towards the front section, which section has a recess or hole in its lower surface for receiving the lock pin to aid in engaging the toe stop and positioning it on the roller skate plate in a nonrotatable manner.

Attention now is directed to the details of the roller skate shown in the accompanying drawings and a roller skate is indicated as a whole by the numeral 10, which skate is of any conventional construction. This skate includes a metal skate plate 12 that has any conventional type of wheel means 14 and 16 operatively positioned on the skate plate.

As an important feature of the invention, a toe stop 18 is mounted on a front section 20 of this skate plate. The front section 20 preferably has a downwardly and rearwardly inclined lower surface 22, and the toe stop normally is mounted on an axis perpendicular to this lower surface.

A conventional screw or other known type of a mounting member is operatively engaged with the toe stop 18, and this member, such as a cap screw or bolt 24, normally operatively engages a metal washer 26 that is embedded in the toe stop spaced from the upper surface thereof. Such cap screw 24 extends axially up into a tapped hole 40 provided in the front section 20 and is secured thereto in a conventional manner to retain the toe stop in good operative engagement with the metal skate plate 12.

It is important that this toe stop be held against rotation when the user of the skate tilts the metal skate plate 12 forwardly and brings the toe stop into engagement with the support surface. At that time, relatively large torque forces are applied to the toe stop and it may be urged to rotate or it may be torn from its mounting means. The toe stops just do not usually have a good operative life when positioned on skate plates by use only of an axial or center positioning pin. The present invention provides a lock pin 30 which is at least partially embedded into the toe stop 18 and may be secured or welded to the metal washer 26 to protrude from the toe stop towards the front section 20 of the skate plate. Such lock pin 30 preferably is received in or engages a recess or aperture 32 provided in the front section 20 and extending thereinto from its lower surface 22.

By the engagement of this protruding portion of the lock pin 30 with the hole 32 in the metal skate plate, an added resistance is set up to any rotary motion of the toe stop or any forces tending to give an arcuate movement to the toe stop in relation to the skate plate whereby rotation of the toe stop is prevented. Hence, the cylindrical stop 18 will be effective as a braking and control medium by the person using the skates 10.

It should also be understood that a plurality of these holes 32, 32*a*, or 32*b* could be provided around the surface of the skate plate front section 29 so that the toe stop could, if desired, be removed from engagement with the skate plate, be rotated about 120° on its own axis, for example, and then be resecured in position with the lock pin engaging a different hole 32*a* or 32*b* as indicated in the drawings.

The stop 18 may abut against or be spaced slightly from the front section 22.

The toe stops of the invention are relatively readily applied to conventional skate plates, if desired, by just drilling a small hole into the lower surface of the front section of the skate plate 12 and having the lock pin 30 then be received in such holes.

Of course, any type of securing means can be used for operatively positioning the toe stop on the front section of the metal skate plate and such means preferably are of the type that would enable one to remove the toe stop from engagement with the roller skate, but then to reassemble the two as desired with a new attaching member, if required.

The apparatus of the invention is relatively simple and inexpensive, but it still will provide greatly improved braking action and a good life for the toe stop of the roller skate. Hence, it is believed that the objects of the invention have been achieved.

While one complete embodiment of the invention has been disclosed herein, it will be appreciated that modification of this particular embodiment of the invention may be resorted to without departing from the scope of the invention.

What is claimed is:

1. In a roller skate, a metal skate plate including a front section having a rearwardly directed, downwardly inclined lower surface, said front section having a tapped hole extending thereinto from said surface, a cylindrical stop member, a reinforcing means embedded in said stop member, means engaging said hole and securing said stop member to said front section, and said stop member being made from a durable plastic material, and a lock pin embedded at a portion of said stop member and fixedly attached to said reinforcing means, and protruding therefrom towards said front section, said front section having a recess or hole in its lower surface for receiving said lock pin to aid in mounting said stop member on said roller skate.

2. In a roller skate as in claim 1, said lock pin being offset radially from the center axis of said stop member, said front section having a plurality of circumferentially spaced holes in its lower surface and all equally spaced from said center line for individual receipt of said lock pin when said stop member is released and rotated through an arc and is reattached.

* * * * *